United States Patent [19]

Workman

[11] Patent Number: 4,784,248

[45] Date of Patent: Nov. 15, 1988

[54] PIPING FOR LUGGAGE AND THE LIKE

[75] Inventor: David E. Workman, Evergreen, Colo.

[73] Assignee: Samsonite Corporation, Denver, Colo.

[21] Appl. No.: 91,558

[22] Filed: Aug. 31, 1987

[51] Int. Cl.[4] ..... A45C 13/36

[52] U.S. Cl. ..... 190/126; 150/128; 112/419

[58] Field of Search ..... 112/419; 190/28, 37, 190/124, 126, 127; 150/128

[56] References Cited

U.S. PATENT DOCUMENTS

| | | | |
|---|---|---|---|
| Re. 26,443 | 8/1968 | Kish, Jr. | 190/126 X |
| 1,999,424 | 2/1933 | Seitz . | |
| 2,247,291 | 6/1941 | Doig | 190/37 X |
| 2,440,138 | 11/1945 | Benenfeld . | |
| 2,684,136 | 7/1954 | Wheary, Jr. | 190/126 |
| 2,689,028 | 9/1954 | Hartman | 190/127 X |
| 2,848,079 | 8/1958 | Brodie | 190/126 |
| 2,854,105 | 9/1958 | Arlitt, Jr. | 190/126 |
| 2,889,020 | 6/1959 | Kotkins | 190/28 |
| 3,233,644 | 7/1962 | Bono . | |
| 3,305,052 | 2/1967 | Kish, Jr. | 190/126 X |
| 3,411,610 | 11/1968 | Bialo | 190/127 X |
| 3,730,308 | 5/1973 | Pelarin | 190/124 X |
| 3,741,355 | 6/1973 | Slan | 190/124 |
| 4,055,239 | 10/1977 | Weiner | 190/126 |
| 4,383,142 | 5/1983 | Kaneko | 190/126 |

FOREIGN PATENT DOCUMENTS

| | | | |
|---|---|---|---|
| 163246 | 6/1955 | Australia | 190/124 |
| 793142 | 4/1958 | United Kingdom | 190/124 |
| 868686 | 5/1961 | United Kingdom | 190/124 |

*Primary Examiner*—William Price

*Attorney, Agent, or Firm*—Gregory W. O'Connor

[57] ABSTRACT

Flexible extruded piping for use between adjacent panels of luggage or the like. Shoulders extending outwardly from the sides of the tubular portion are of a different color than that of the exposed tubular portion to provide a color trim. The shoulders stabilize the piping to prevent twisting of the piping around corners, thereby maintaining the neat appearance of the trim. The different colored parts of the piping are formed by coextruding different colored plastic material.

8 Claims, 1 Drawing Sheet

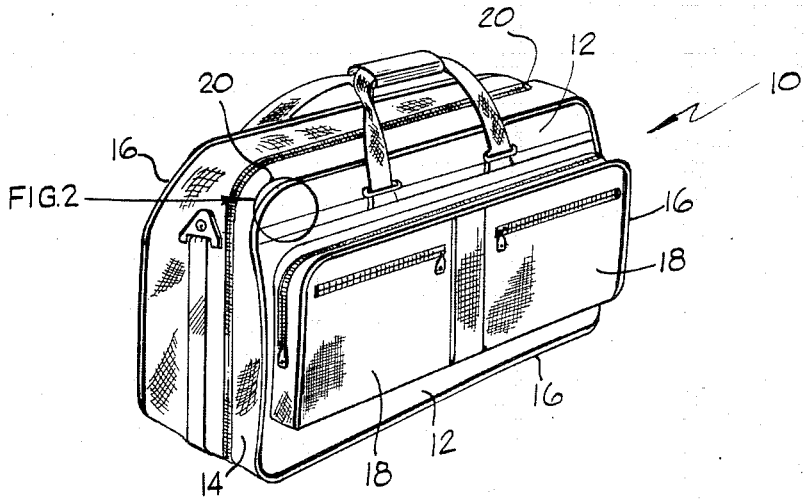
FIG.1.
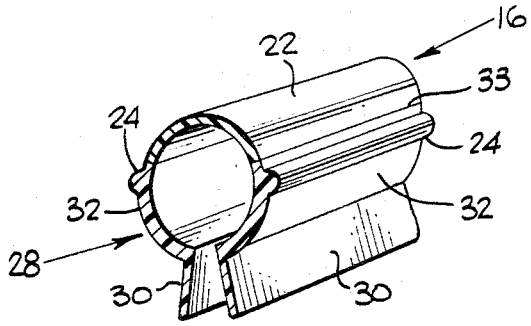
FIG.3.
FIG.4.
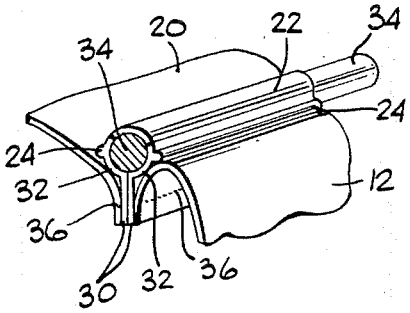
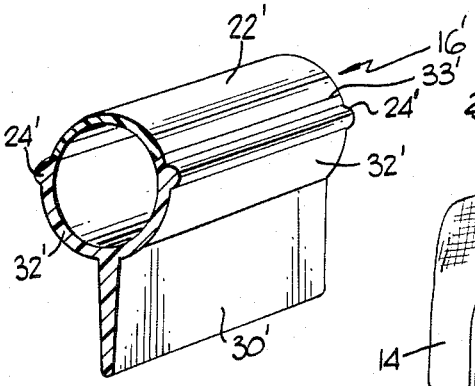
FIG.5.
FIG.2.
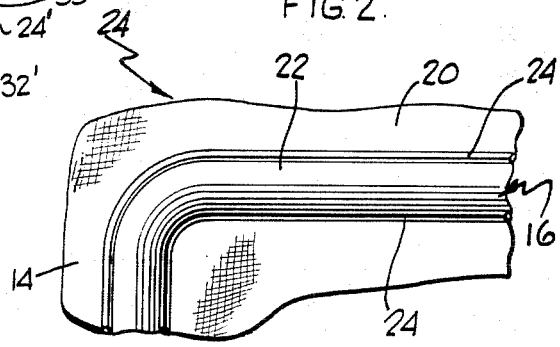

PIPING FOR LUGGAGE AND THE LIKE

FIELD OF THE INVENTION

This invention relates to beading or piping. More particularly, it relates to improved piping for use in luggage or the like.

BACKGROUND OF THE INVENTION

Flexible beading or piping is commonly used in the fabrication of luggage as a means of separating and securing adjacent panels of the luggage container. The adjacent edge portions of the panels typically are sewn to legs or flanges of the piping which extend beneath the outer face of the panels, leaving exposed to view only the usual outer tubular portion of the piping. Depending upon the specific type of luggage involved, the piping may be reinforced, such as by hard wire or coil wire inserted into the tubular portion.

Whether or not the piping is reinforced, however, it tends to twist under the torsional stresses to which it is exposed in the corner areas, that is, where a straight run of piping changes direction about a relatively small radius. When twisting occurs the tubular portion of the piping reacts by tending to roll away from the adjacent luggage panel in the general direction of the twisting force, which can produce an unattractive uneven line of demarcation between the piping and the material of the adjacent panel. If the piping is not of uniform appearance throughout its length to begin with, the effect of the twisting is aggravated. For example, if the tubular portion of the piping were striped or the edges were colored differently from the rest of the exposed piping, the panel edges would appear to the viewer to be even more uneven.

It would be desirable, in view of the above problem areas, to provide a piping arrangement in luggage which overcomes the twisting problem described above. It would further be desirable to provide a piping design which allows a striped or multicolored piping to be used without endangering the overall appearance of the luggage due to the risk of twisting.

BRIEF SUMMARY OF THE INVENTION

This invention provides piping which has shoulder portions extending outwardly from the sides of the exposed tubular portion of the piping. The shoulder portions are arranged so that the outer faces of the adjacent luggage panels abut the piping below the shoulder portions, making the shoulder portions visible. The shoulder portions stabilize the piping to minimize any twisting effects of the torsional stresses to which the piping is exposed at the corners. This allows a multicolored piping to be used, such as one having contrasting trim stripes running along the edges of the exposed piping, which does not run the risk of appearing ragged and uneven as it would if the adjacent panel covered parts of the stripes. In a preferred embodiment the piping is formed as a coextrusion where the shoulder portions are of a different color than the visible tubular portion of the piping extending between the shoulders, thus providing for a contrasting edge trim.

Other features and aspects of the invention, as well as its various benefits, will become more clear in the detailed description of the preferred embodiment which follows.

BRIEF DESCRIPTION OF THE DRAWINGS

FIG. 1 is a pictorial view of a luggage bag incorporating the piping of the present invention;

FIG. 2 is an enlarged partial plan view of a corner of the piping incorporated in the luggage bag of FIG. 1;

FIG. 3 is a pictorial view of a portion of the length of the piping of the present invention;

FIG. 4 is a pictorial view of the piping of FIG. 3 shown in place between two adjacent panels of a bag of luggage; and FIG. 5 is a pictorial view similar to that of FIG. 3, but showing a modified flange portion.

DESCRIPTION OF THE INVENTION

Referring to FIG. 1, a carry-on luggage bag 10 is comprised of front panels 12 connected to side panels 14 by means of piping 16 which serves as an aesthetically pleasing separator strip or border as well. Similar piping is used between the front and back panels and their adjacent top and bottom panels. It is also used to connect the pocket 18 to the front panel 12. As can be seen, the piping 16 follows the perimeter of the bag and the pockets, and encounters a number of corners.

The upper left piping corner arrangement circled in FIG. 1 is illustrated in enlarged form in FIG. 2, wherein the piping 16 separates the front panel 12 from the side panel 14 and the top panel 20. The piping appears to the viewer as a rounded elongated portion 22 the borders 24 of which are of a different color than the main elongated portion. The different colored borders are of uniform width and are not hidden in any area by the adjacent panels 12, 14 or 20. Note that the crisp appearance of the borders remains intact even around the sharp corner area designated generally by reference numeral 26, indicating that the torsional forces at the corner area are not enough to twist the piping out of its intended alignment.

Referring to FIG. 3, one embodiment of the twist resistant piping 16 comprises a generally tubular portion 28 terminating in two spaced legs or flanges 30. The generally tubular portion 28 is made up of the rounded upper portion 22, referred to in connection with FIG. 2, and two curved lower portions 32 which extend downwardly from the upper portion 22 to connect with the upper ends of the flanges 30. Extending outwardly from the tubular portion 28 at approximately the juncture between the upper portion 22 and the lower portions 32 are shoulders 24. Although it is not essential that the manufacture of the piping be done in this manner, it is preferred that the piping be comprised of a suitable extrudable plastic and that the upper portion 22 be coextruded with the sections comprising the shoulders 24, the lower portions 32 and the legs or flanges 30. Thus the upper portion 22 would be Joined to such sections along the knit line 33 of the coextrusion. In this way the upper tubular portion 22 can be formed from one color of extrudable material and the other sections can be formed from a different color.

As shown in FIG. 4, the only part of such sections which would be visible after the piping has been installed is the shoulder 24, which is illustrated as extending outwardly from the tubular portion 32 overlying the panels 12 and 20. The appearance of such an arrangement is that of piping having a main body portion of one color with the side edges of the body portion trimmed in a different color. The main body portion of course is formed of the tubular portion 22 and the side edge trim is comprised of the shoulders 24. Because the shoulders stiffen the tubular portion of the piping and stabilize the piping against twisting due to torsion stresses at the corners, the adjacent panels 12 and 20 do not ride up over the shoulders, thus leaving the tubular portion 22 and the shoulders 24 visually intact throughout the length of the piping.

Still referring to FIG. 4, the tubular portion of the piping is shown as being reinforced by wire 34, which as mentioned previously is usually either hard wire or coil wire. The wire will have been inserted into the tubular cavity prior to the legs 30 of the piping being attached to the adjacent panels. In this illustration one leg is depicted as being attached by stitching 36 to the edge portion of panel 12, and the other leg is depicted as being attached by stitching 38 to the edge portion of panel 20.

It is not necessary to the invention that wire reinforcement be used. It would not normally be employed, for example, when the piping is used in connection with pockets such as those shown in FIG. 1 at 18, since it is not necessary that the piping be rigid in this area. In such a case unreinforced piping of the type shown in FIG. 5 would be used, which shows a length of piping 16' having an upper normally exposed tubular portion 22' connected to shoulders 24' which in turn are connected to lower tubular portions 32' in the same manner as the corresponding elements of the piping 16 of FIG. 3 are constructed. Instead of the lower tubular portions 32' terminating in separate depending legs, as in the FIG. 3 arrangement, they are integrally joined with a single leg 30' depending from the lowermost point of the lower tubular portion 32'. This arrangement is suitable in this instance because there is no need to insert a reinforcing wire into the cavity of the upper tubular portion 22'. As in the embodiment of FIG. 3, it is preferred that the piping be produced by coextruding two separate plastic compositions, the knit line between them being indicated at 33'.

As shown in both FIGS. 3 and 5, it is preferred that the wall thickness of the lower tubular portions 32 and 32' be greater than the wall thickness of the upper tubular portions 22 and 22' for the purpose of structural stability. Thus the lower tubular portions 32 and 32' lend support to the legs 30 and 30', which have to be relatively substantial in order to provide a sturdy attachment to the edges of the luggage panels. In order to provide suitable resistance to twisting and to cover any unevenness in the adjacent luggage panel, the shoulders should extend outwardly a great enough distance so that the thickness of the shoulders, as measured from the cavity wall of the tubular portion to their outer edge, is greater than the wall thickness of the upper or lower tubular portions.

It should now be clear that the present invention provides a number of benefits. The shoulders stabilize the piping against the torsional stresses at corner areas, yet allow the piping to bend evenly and consistently around corners so that the legs or flanges remain in an even uniform relationship to each other, thus reducing stresses in the legs. In addition to the structural benefits, the shoulders are aesthetically pleasing because they add a hefty substantial appearance to the piping. They also hide the stitching in the event uneven stress on the stitching tends to pull it out toward the face of the luggage.

In addition to the above benefits the use of shoulders on piping permits a colored trim effect to be implemented. Because the shoulders stay in place with respect to the adjacent panels, when the shoulders are of a different color the trim line remains even around corners and presents a neat appearance. The benefits of this effect need not be limited to areas of different colors only, but can be incorporated in piping which utilizes an exposed tubular portion which has a different surface appearance in any respect than the surface appearance of the shoulders. It would also be useful in piping having a striped design since the shoulders would prevent the panel material from riding up over part of the piping and making the edge appear wavy.

It should now be obvious that although a preferred embodiment of the invention has been described, changes to specific details of the embodiment can be made without departing from the spirit and scope of the invention as defined in the claims.

What is claimed is:

1. In a luggage container or the like, comprising adjacent panels the outer faces of which are separated by flexible piping the flexible piping comprising a tubular portion at least part of which is exposed to view, and leg means extending from the tubular portion internally of the luggage container, the adjacent edge portions of the adjacent panels being attached to the leg means of the piping, the improvement comprising:

a shoulder extending outwardly from each side of the tubular portion of the piping, the shoulders acting to stabilize the piping against twisting when exposed to torsional stress;

the outer faces of the adjacent panels abutting the piping below the shoulders so that the shoulders are visible, and wherein the exposed tubular portion is formed of a wall the thickness of which is less than the thickness of the shoulders.

2. In a luggage container or the like, comprising adjacent panels the outer faces of which are separated by flexible piping, the flexible piping comprising a tubular portion at least part of which is exposed to view, and leg means extending from the tubular portion internally of the luggage container, the adjacent edge portions of the adjacent panels being attached to the leg means of the piping, the improvement comprising:

a shoulder extending outwardly from each side of the tubular portion of the piping, the shoulders acting to stabilize the piping against twisting when exposed to torsional stress;

the outer faces of the adjacent panels abutting the piping below the shoulders so that the shoulders are visible, and wherein the wall thickness of the exposed tubular portion is less than the thickness of the wall forming the piping below the shoulders.

3. In a luggage container or the like, comprising adjacent panels the outer faces of which are separated by flexible piping the flexible piping comprising a tubular portion at least part of which is exposed to view, and leg means extending from the tubular portion internally of the luggage container, the adjacent edge portions of the adjacent panels being attached to the leg means of the piping, the improvement comprising:

a shoulder extending outwardly from each side of the tubular portion of the piping, the shoulders acting to stabilize the piping against twisting when exposed to torsional stress;

the outer faces of the adjacent panels abutting the piping below the shoulders so that the shoulders are visible, and wherein the exposed surfaces of the shoulders are of contrasting appearance to the surface of the exposed tubular portion.

4. In a luggage container according to claim 3 wherein the exposed surfaces of the shoulders are of a different color than that of the surface of the exposed tubular portion.

5. Flexible piping for use in luggage containers or the like, comprising;

a generally tubular portion;

leg means extending from the tubular portion and adapted to be attached to the edge portions of adjacent luggage panels; and shoulders extending outwardly from opposite sides of the tubular portion, the shoulders adapted to overlie adjacent luggage panels so as to be visible to a viewer, wherein the surface of the shoulders is of contrasting appearance to that of the tubular portion extending above the shoulders, and wherein the shoulders stabilize the piping to resist twisting during use.

6. Flexible piping according to claim 5, wherein the shoulders and the tubular portion extending above the shoulders are of different colors.

7. Flexible piping according to claim 6, wherein the piping is comprised of extrudable plastic material, the tubular portion extending above the shoulders having been coextruded with the other portions of the piping.

8. Flexible piping according to claim 7, wherein the wall thickness of the tubular portion extending above the shoulders is thinner than the wall thickness of the remainder of the piping.

* * * * *